United States Patent [19]

Cady

[11] Patent Number: 4,544,446

[45] Date of Patent: Oct. 1, 1985

[54] VLSI CHEMICAL REACTOR

[75] Inventor: Wayne A. Cady, Easton, Pa.

[73] Assignee: J. T. Baker Chemical Co., Phillipsburg, N.J.

[21] Appl. No.: 633,938

[22] Filed: Jul. 24, 1984

[51] Int. Cl.[4] ..... B44C 1/22; C03C 15/00; C03C 25/06

[52] U.S. Cl. ..... 156/639; 134/33; 134/149; 156/626; 156/646; 156/345; 269/21; 430/434

[58] Field of Search ..... 156/345, 636, 637, 639, 156/646, 626; 269/21; 134/3, 21, 25.5, 28, 29, 30, 32, 33, 34, 149, 157; 430/434; 354/297, 300

[56] References Cited

U.S. PATENT DOCUMENTS

| | | | |
|---|---|---|---|
| 3,043,362 | 7/1962 | Mennesson | 156/345 |
| 4,021,278 | 5/1977 | Hood et al. | 156/345 X |
| 4,161,356 | 7/1979 | Giffin et al. | 156/345 X |
| 4,339,297 | 7/1982 | Aigo | 156/345 |
| 4,350,562 | 9/1982 | Bonu | 156/345 X |
| 4,430,149 | 2/1984 | Berkman | 156/662 X |
| 4,495,024 | 1/1985 | Bok | 156/345 X |

FOREIGN PATENT DOCUMENTS 59-03430 1/1984 Japan .

*Primary Examiner*—William A. Powell
*Attorney, Agent, or Firm*—George W. Rauchfuss, Jr.

[57] ABSTRACT

A VLSI chemical reactor includes a fluid flow guide spaced from the corresponding substrate in the form of a wafer for significantly reducing contamination in the processing of semiconductor wafers. Processing chemicals are introduced in a continuous process through a central tube and through the fluid flow guide which is substantially planar and which is parallel to the surface of the wafer. A predetermined gap is maintained between the guide and the wafer such that fluid is maintained in the gap at all times critical in the processing of the wafer. In one embodiment, the guide is optically transparent at predetermined portions to permit monitoring of the chemical reaction taking place on the surface of the wafer to permit control of fluid flow to the wafer. Because of the uniform gap, the fluid guide insures a constant thickness and composition of the opticalpath, and thus more accurate measurements. All drying steps are done directly and include the steps of replacing the working fluid with an inert gas and increasing the speed of rotation of either the wafer or the guide to remove any liquid or particulate matter by centrifugal force. Bubble reduction and fluid mixing apparatus, including different fluid guide configurations, gas relief orifices and offset rotational axes, are also described. Moreover, in one embodiment orthogonal and orbital vibrating arrangements are used in lieu of rotating motion.

31 Claims, 27 Drawing Figures

VLSI CHEMICAL REACTOR

FIELD OF THE INVENTION

This invention relates to the processing of semiconductors wafers or other substrates and, more particularly, to a chemical reactor for electronic grade chemicals and a control system therefor.

BACKGROUND OF THE INVENTION

The integrated circuit industry demands chemicals with higher purity and lower levels of particle contamination in order to produce very large-scale, integrated (VLSI) circuits. While current techniques are utilized to improve the quality of VLSI chemicals, there is a requirement that delivery of VLSI chemicals to the point of use and during use be controlled to eliminate contamination. Thus in the past there has been a substantial effort expended in the area of packaging in which "clean room" techniques and "double bag" techniques are utilized to reduce the contamination of chemicals when they are employed to clean or modify the surface of a semiconductor wafer.

Traditionally, the semiconductor industry has utilized batch processing in which "boats" containing about twenty-five silicon wafers are processed stepwise and frequently are moved from process area to process area manually. To reduce human error, as well as to reduce the level of human-contributed particulate contamination, the semiconductor industry is moving toward continuous processes. At the same time, with the steadily shrinking geometries of the devices on the wafer, uniform processing of the wafers is becoming more important. With batch processing, it is not always possible to react each of the wafers in the boat or different regions across the wafer in the same manner. Thus it is important to develop an integrated continuous system which can be used at the wafer cleaning step, at the resist developing step and at the etching step.

Not only is uniform treatment from wafer to wafer growing in importance, but also precise control of the extent of the reaction is becoming critical. For instance, precise development of the photoresist is important to insure that patterns formed are of exactly the desired size. This is becoming increasingly important for such devices as the 256K memory chips presently in production.

Of particular concern in the reduction of contamination is wafer cleaning. As indicated in an article by Aaron D. Weiss, in *Semiconductor International,* Volume 82, April 1984, there are basically four types of wafer cleaning, each with its own problems. The first is brush scrubbing, including high pressure scrubbing; the second is sonic cleaning, utilizing ultrasonic techniques; the third is chemical cleaning in a bath; and the fourth utilizes a centrifugal spray.

As indicated in this article, shrinking of device geometries has been the driving force in the semiconductor industry. A primary concern in the fabrication of VLSI devices is the level of contamination the wafers are exposed to and removal of such contamination from the surface of the wafers before further processing. Each of the different wafer cleaning techniques described above has advantages for removing a specific type of contamination. For example, wet chemical cleaning is efficient in removing alkaline metal ions that may be either physically or chemically attached to the wafer surface. These techniques are highly specific to the type of contaminant and are also subject to the condition of the wafer surface. It will be appreciated that cleaning of wafers is done after sawing, lapping and polishing; before coating with resist, before diffusion, and after dicing. The types of contaminants range from organics encountered by handling or processing to heavy metal ions and particulates. Contaminants may be visible or invisible and may either chemically or physically attached to the wafer surface. Generally, any contaminants on the wafer can decrease the device performance and, in some cases, completely destroy the device. For instance, contaminants left on the wafer can cause pin holes and poor resist adhesion. Particulates left on the wafer can cause device defects which are exemplified by shifts in electrical parameters and complete device failure.

With respect to brush scrubbing, the bristles of the brush do not actually come into contact with the wafer surface because of the hydrophilic nature of the brush material. Thus there is usually a film of the scrubbing solution between the brush bristles and the wafer surface. Secondly, the hydrophilic character of the bristles helps sweep off suspended contaminants from the wafer surfaces that are hydrophobic. Wafers that have a surface that is hydrophilic are more difficult to scrub because contaminants suspended in the scrubbing solution can precipitate onto the wafer topography. Scrubbing, while it will remove particulates, will not remove contaminants unless they are soluble in the scrubbing solution, which is most often water based. Furthermore, contaminants that are chemically attached to the wafer surface cannot be removed by scrubbing alone. This requires the use of a chemical agent or solution to release the contaminant from the wafer surface. Chemical cleaning can be used in conjunction with scrubbing. However, as device geometries shrink, there is concern that the bristles of the brushes may not effectively remove contaminants. In order to eliminate this problem, high pressure scrubbing with a jet of fluid swept across the wafer surface at pressure of from 300–4000 psi is useful to get into topography which the bristles cannot touch. However, the major problem with high pressure sprays is static electricity which damages the delicate devices which are being manufactured into the wafer.

Ultrasonic cleaning, which forms bubbles from cavitation, is utilized in order to scrub wafer surfaces, while megasonic scrubbing utilizes high pressure waves set up in the solution rather than implosion of bubbles. Note, the frequency of the megasonic energy is too high for the creation of bubbles. Regardless of the utilization of ultrasonic cleaning, wafer handling is still a problem in that the removal of the wafer from the sonic bath into the atmosphere and then to another place for processing can engender the pickup of contaminants. Thus a much-stated goal in the semiconductor industry is removal of people from the clean room in order to eliminate one of the major sources of contaminants. To do this, processing equipment must have automatic wafer handling mechanisms. These mechanisms, however, can be a source of particulate generation. Therefore, an important aspect of the automated wafer cleaning equipment is the wafer handling mechanism which must not generate particulates in and of itself. Furthermore, it must not break wafers. Broken wafers can be a catastrophe in a scrubber, which results in the generation of large quantities of silicon particulates.

With respect to chemical cleaning, various dip and dunk techniques are utilized which result in contaminated wafers during transfer to and from the bath. An alternative to the immersion type system is the centrifugal spray cleaning mentioned above in which a centrifugal spray cleaning unit sprays fluids onto the wafers such that each wafer is continuously exposed to fresh cleaning or rinsing solution. This helps prevent recontamination of the wafers by dirty solutions. The advantage of this type of chemical cleaning is that the wafers are housed in a closed environment throughout the entire process.

A drawback of the sonic as well as the dip and dunk methods is that the substrates must be withdrawn from the tank through the liquid surface which is well known to collect particulates. Thus, the particulates are redeposited on the clean substrate when it is withdrawn from the liquid. Even with a spray, the surface of the liquid droplet can sweep particulate contamination from the environment and deposit it on the substrate surface.

One major drawback with respect to the spraying systems is that the uniformity of the chemical reaction produced by the sprayed material cannot be carefully controlled. Moreover, the distribution of chemicals on the wafer surface is not uniform. Additionally and more importantly, the chemical reaction cannot be measured by optical methods when using a spray or mist. Therefore, careful control of the chemical reaction on the wafer surface cannot easily be accomplished when utilizing spray techniques.

Finally, wafer drying is a critical step after the cleaning technique. The wafers must be dried in such a way as to prevent recontamination. The technique used for drying depends in large measure on the type of wafer surface, either hydrophilic or hydrophobic. In general, hydrophobic surfaces are easier to dry than hydrophilic surfaces. A common method utilized for drying is spin drying. For a hydrophilic surface, the spin speed should be carefully controlled to prevent an aerosol from forming which can recontaminate the wafer. Spinning should start out at low rpm until all but a thin film of liquid is left on the wafer surface, whereupon the spin speed can be increased. Drying hydrophobic wafers is different in that water droplets form and roll off as the wafer is spun. However, at the center of the wafer the van der Waals forces prevent the droplets from rolling outward. Thus a flow of nitrogen directed at the center of the wafer is needed to move the droplets. Nitrogen is generally not used for hydrophilic wafers because it will cause an aerosol to form.

In all of the prior art devices thus described, it is possible during the processing that the surface of the wafer can be contaminated because there are times at which unreacted active chemicals on the wafer surface are exposed to air. This is due primarily to the lack of fluid layer between the ambient and the wafer surface. Thus no matter how pure the chemicals used in the processing of the wafer, should any of these active areas be exposed to the atmosphere, contamination will result.

U.S. patents dealing with machine cleaning of semiconductor wafers include U.S. Pat. Nos. 3,760,822; 4,015,615; and 3,990,462. An example of the jet/brush scrubber is Solitec Model 1100-SD available from Solitec, Inc. in Mountain View, California.

Two U.S. patents which deal with a method of providing for a chemical reaction which travels across a flat rotating plate are U.S. Pat. No. 4,124,411 and U.S. Pat. No. 4,356,133. Also of note is an article in the *Journal of Crystal Growth,* Volume 41, No. 2, December 1977, pages 205–215, which describes the rotating disc method for growth of a number of crystals. In none of the apparatus described in the prior art is a predetermined fluid gap and an ever-present fluid proposed between the top of the wafer surface and the fluid guide, which is the subject of the present invention.

Attention is also drawn to Japanese Patent No. GO6 84-040358/07 J5 9003430-A issued to Fujitsu Ltd. in which photoresist is apparently coated on two rotating opposed base plates. Here there is no fluid guide or fluid dispensed through a fluid guide nor is there any monitoring of mixing reactions through a fluid guide.

While the processing of VLSI wafers has been previously discussed, cleaning and other types of processing of other types of substrates in which contamination is a problem include masks, optical windows and plates, and printed circuit boards.

SUMMARY OF THE INVENTION

In order to prevent contamination, in the subject system a fluid barrier, either gas or liquid, is maintained over the substrate surface at all times reactive material is on the substrate surface. For this purpose, a fluid flow guide is positioned immediately over the substrate for significantly reducing contamination in the processing of the substrate. The guide is generally maintained at a predetermined gap above the substrate and is usually flat and parallel to the top surface of the substrate. Either the guide or the substrate or both are rotated during processing so fluid introduced at or near the center of the guide is moved outwardly across the substrate surface. Chemicals are introduced through a central tube and through the fluid flow guide into the gap between the substrate and the guide. A predetermined gap is maintained between the guide and the substrate such that a fluid is maintained in the gap at all times critical in the processing of the substrate. In one embodiment, the guide is optically transparent at predetermined portions to permit monitoring of the chemical reaction taking place on the surface of the substrate, thereby permitting control of fluid flow to the substrate. Because of the uniform gap between the guide and the substrate, a constant thickness and composition optical path exists, making accurate measurements and system control possible. Moreover, regardless of what steps are utilized in the treating of the surface of the substrate, a drying step is done directly and includes the steps of replacing the working fluid with an inert gas and increasing the speed of rotation of either the substrate or the guide so that the fluid flow rinse is replaced by an inert gas stream, with the substrate spin being increased to remove any liquid particulate matter by centrifugal force. Thus drying is never allowed to occur during the processing and thus deposit of insoluble residue is avoided. The inert gas is turned off after all reactive components have been swept away from the surface of the processed substrate. The result is that when an active chemical process is being performed on the substrate there is always a fluid barrier between the surface of the substrate and the ambient.

The guide can take on a number of configurations to effectuate turbulent action, including spiral channels or ribs and multiple fluid introduction orifices. Bubble formation, which can create nonuniform processing, can be eliminated by gas relief orifices in the guide and through offset rotational axes for the guide and the substrate.

Note that, while this invention relates to substrates of all kinds, its use will be described hereinafter in connection with VLSI wafers because of the criticality of VLSI wafer processing and because of the above-noted problems associated with prior art contaminant and reaction control for these delicate devices.

In general, a vacuum chuck is used in the mounting of the wafer, with the chuck being optionally provided with heating and/or cooling apparatus as desired for the particular operation being performed on this wafer. In addition, an adhesive or mechanical technique can be employed to hold the substrate in place.

The wafers are not located in boats but are processed on individual chucks mounted adjacent fluid guides and chemical supply apparatus, with a number of different process treatments being done sequentially without moving the wafer out from under the guide where ambient air and contaminants are available to contaminate the wafer. When it is necessary to remove the wafer, it is first washed and dried in a fluid environment until all active chemicals or reagents are removed from the wafer surface so that air and airborne particulates will not contaminate the wafer. In this matter the apparatus permits continuous processing through a series of sequential steps.

Thus there is always a gap between the guide and the wafer which is filled with fluid, either liquid or gas, which isolates the surface of the wafer from the ambient. Only fresh chemicals are used, and the control system and seals prevent contamination from outside sources. Note that recycled chemicals could be used, but the chance of contamination increases as well as problems with changes in potency.

Various advantages to the use of a fluid guide and a continuous fluid interface are that it reduces the amount of chemicals needed for processing each wafer; it eliminates the need to recirculate or reuse chemicals that may have changed in concentration or have been contaminated; it isolates the chemicals from the air and other possible contamination sources before and during use; it eliminates the need for wafer trays, boats, or holders, sources of particulate and chemical contamination when introducing the wafers into the chemicals; it permits the performance of all chemical reaction processes as well as washing, rinsing, and drying at one location to prevent contamination from the atmosphere between steps; and it eliminates all air-liquid wafer interfaces, major sources of particulate contamination during processing. The reactor can be used for all steps in the manufacture of integrated circuits that can use electronic grade chemicals. This includes chemical cleaning, etching, resist developing, and resist stripping. It is very compact, requiring little floor space; and it is very amenable to automation. Thus throughput can be increased. More importantly, people, and major source of particulate contamination, are isolated from the process.

Additionally, optical monitoring of the chemical reaction across the wafer permits process control. Moreover, and both orthogonal and orbital motions for the guide and wafer are within the scope of this invention.

BRIEF DESCRIPTION OF THE DRAWINGS

These and other features of the subject invention will be better understood in connection with the detailed description taken in conjunction with the drawings of which.

DETAILED DESCRIPTION

Figure 1:
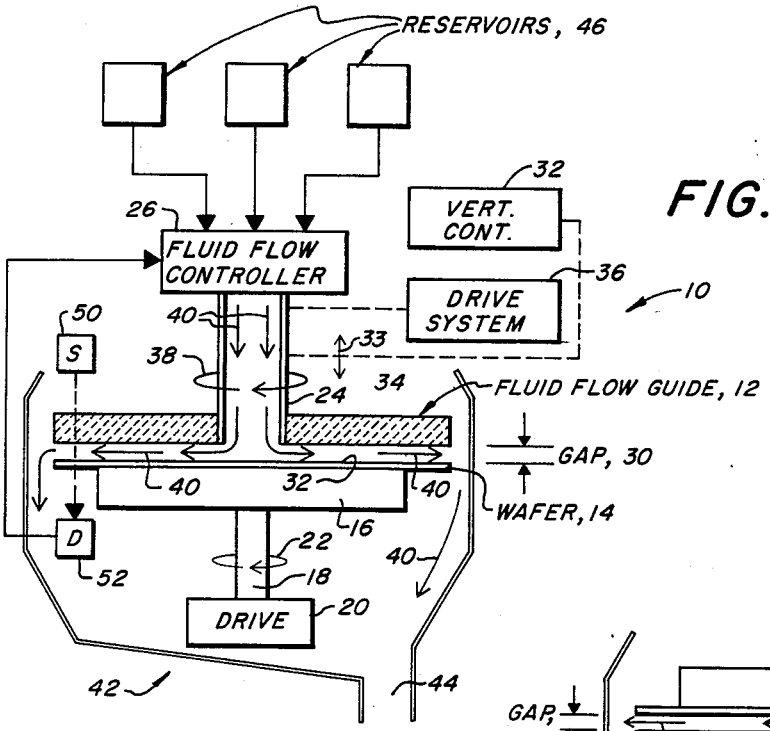
FIG. 1 is a diagrammatic illustration of the subject chemical reactor illustrating a centrally fed fluid flow guide maintained at a predetermined gap above a wafer to be processed, also illustrating a feedback path for the controlof the fluid through the reactor.

Referring to FIG. 1, in one embodiment, a chemical reactor 10 useful for VLSI purposes includes a fluid flow guide 12 spaced from a substrate in the form of a wafer 14 supported on a holder 16, usually a vacuum chuck, which is driven by shaft 18 via drive 20 to rotate in the direction of arrow 22, although the chuck can be made to rotate in either direction. As illustrated, the fluid flow guide is of transparent material and may be made of such materials as glass, quartz, or plastic. The fluid flow guide may be constructed of nonreactive materials such as stainless steel. In addition, it may be coated with a protective material such as Teflon to prevent chemical attack of the fluid flow guide. The fluid flow guide is supported centrally on a central conduit 24 which communicates with the center of the fluid flow guide and which conducts fluid from a conventional fluid flow controller 26 to the area in the gap, here labeled gap 30, which is adjustable by a vertical control unit 32 of conventional design which moves conduit 24 up and down, thereby positioning fluid flow control guide 12 parallel to the top surface 32 of wafer 14 with the bottom surface 34 of the fluid flow guide being parallel to the top surface of the wafer. Note that support by the central conduit is not necessary but is convenient. In one system, drive 20 may be eliminated and a drive 36 utilized to drive conduit 24 which rotates fluid flow guide 12 in the direction of arrow 38. In certain instances it is either desirable to rotate the fluid flow guide or to rotate the wafer or to rotate both either in the same direction or in opposite directions depending on the type of mixing required. Regardless of which of the elements, either wafer 14 or guide 12, is rotated, the fluid flow is indicated by arrows 40 so that the fluid, be it liquid or gas, moves outwardly via centrifugal force and then downwardly as indicated into a chamber 42 which has a drain 44 associated therewith.

Reservoirs 46 of chemicals and/or gas, either under pressure or not, which may be metered or not, provided the necessary chemicals for the chemical processing which takes place in gap 30. The chemicals are contamination free, and the system is sealed such that the fluid path from the reservoirs out through gap 30 is sealed to the extent that the flow path always contains fluid, thereby removing any entrained and undesirable gases or contaminants which are removed at drain 44.

In one embodiment, fluid flow guide 12 is transparent so that when utilizing a light source 50 and a detector 52 the optical density of the path may be measured and the fluid flow controller adjusted accordingly in accordance with a sensed parameter. This assumes that the wafer is at least in part transparent. As will be discussed in connection with FIGS. 13A, B and C, reflective methods of measuring the optical density of the fluid in the gap or substrate surface are described. It is, however, important to note at this point that the gap being uniform provides a uniform thickness optical path which, due to flow in the gap from the center of the guide, outwardly provides an accurate measure of the chemical reaction taking place on the surface of the wafer.

In one embodiment, the wafer is spun at approximately 100 rpm or the fluid flow guide is spun at this relatively low rate. The low rate permits adequate mixing and chemical reaction at the surface of the wafer and is only increased after a rinsing step when an inert gas, such as nitrogen, is pumped in after the rinsing solution, thereby driving out liquid and contaminants by centrifugal force away from the surface of the wafer. During spin-up, in one embodiment the rotation of the wafer may be increased to 2000–7000 rpm. Note that final spin speeds in excess of 7000 rpm are within the scope of the invention. It will also be noted that the gap is determined by the longitudinal motion of conduit 24 as indicated by double-ended arrow 33.

In one embodiment, the fluid guide is made from a quartz disc, which in one embodiment is three and one-half inches in diameter and one-quarter inch thick, with a hole through the center of the disc and a six-inch long, 10 mm OD quartz tube fused to the disc over the hole to serve as a feed-through for the fluid.

Figure 2:
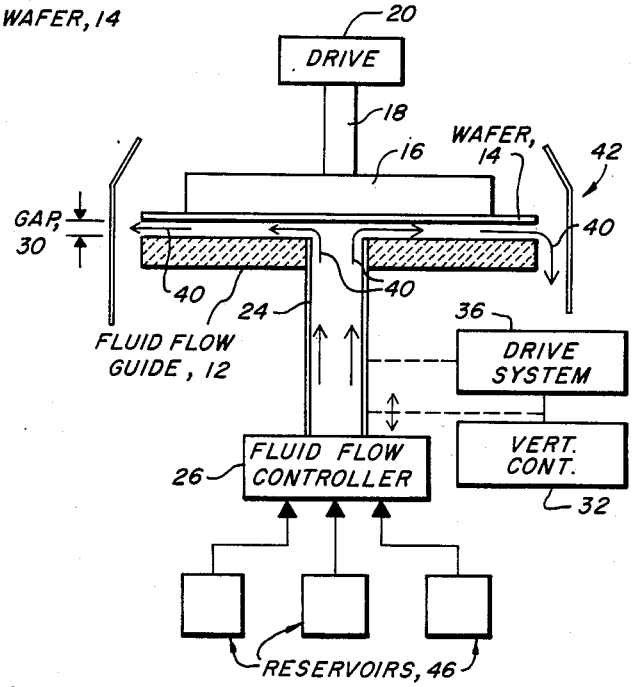
FIG. 2 is a diagrammatic illustration of an inverted form of the chemical reactor of FIG. 1.

Referring to FIG. 2 in which like elements are given like reference characters, it will be appreciated that the entire apparatus may be inverted such that the wafer is suspended from the top via vacuum chuck 16. The inverted system has the advantages of protecting the surface of the substrate from being contaminated by any particulates in the air falling from above, particularly during the loading and unloading steps. In addition, this configuration keeps all chemicals, and liquids and components in one location at the bottom of the reactor. Thus, during removal of the substrate, there is no accidental dripping of liquid on the newly cleaned or processed substrate. It will, of course, be appreciated that the chemicals must be placed under pressure in order to provide for the flow indicated by arrows 40.

Figure 3:
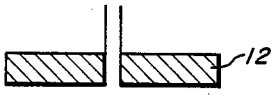
FIGS. 3–7 and 8A are diagrammatic and cross-sectional illustrations of various configurations for the fluid flow guide for use in the chemical reactors of FIGS. 1 and 2.
Figure 4:
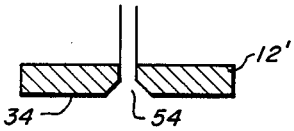
Figure 5:
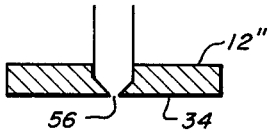
Figure 6:
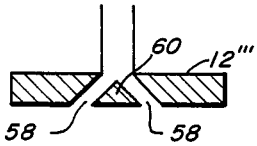
Figure 7:
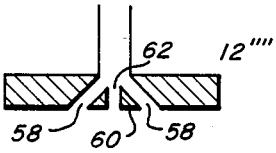
Figure 8A:
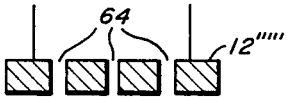
Figure 8B:
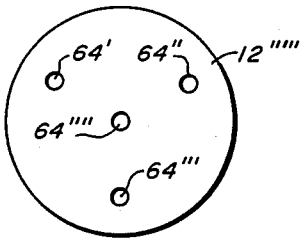
FIG. 8B is a front view of the fluid flow guide of FIG. 8A illustrating the arrangement of orifices therethrough.

Referring to FIG. 3, guide 12 may take on a form of a flat plate with a simple orifice in the center which is coupled to the aforementioned central conduit or tube. Alternatively, as illustrated in FIG. 4, fluid flow guide 12' may be provided with a flared orifice 54 in bottom surface 34. As illustrated in FIG. 5, a limited orifice 56 may be provided in bottom 34 of guide 12'' for the purpose restricting the flow rate, whereas in FIG. 6 guide 12''' may be provided with an expanded divided orifice illustrated by channels 58 which leave a central portion 60 intact in the guide. Referring to FIG. 7, fluid flow guide 12'''' may have the same type of orifice as that of FIG. 6 while still maintaining a central orifice 62 in portion 60. Finally, as illustrated in FIG. 8A, guide 12''''' may be provided with a number of orifices 64 oriented as illustrated in FIG. 8B at 64', 64'', 64''' and 64''''. The latter of these configurations is particularly useful where reaction changes the chemical concentration appreciably as the fluid moves across the wafer or substrate. Note that the orifices need not be round as they can assume a slot or other configuration.

Figure 9A:
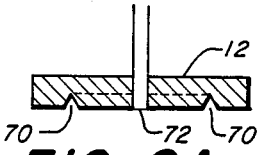
FIG. 9A is a cross-sectional and diagrammatic illustration of one embodiment of the subject fluid flow guide illustrating channels in the bottom surface thereof.
Figure 10A:
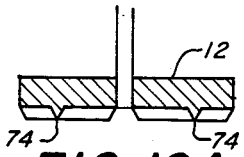
FIG. 10A is a diagrammatic and cross-sectional view of a fluid flow guide illustrating ridges in the bottom surface of the guide.
Figure 9B:
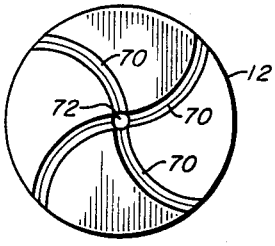
FIG. 9B is a front view of the flow guide of FIG. 9A illustrating a crossed spiral channel construction.
Figure 10B:
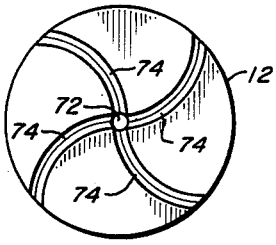
FIG. 10B is a front view of the guide in FIG. 10A illustrating the crossed spiral configuration of the ridges of the guide of FIG. 10A.

In operation, the fluid guide and wafer substrate are capable of turning or spinning relative to each other. Thus either or both systems are equipped with a drive assembly to rotate them. The gap between the wafer and the fluid guide is adjusted to give optimum flow and reaction control for the individual fluids. Both the fluid feed rate and the relative spin speeds are adjusted to give optimum fluid flow and reaction control. The fluid flow controller is attached to the fluid guide assembly or may be separate with feed lines going to the fluid guide assembly. All reservoirs and feed systems are equipped with pumps or other dispensing systems and regulators to provide for the chemicals or gases at the desired rate. The purpose of the gap and the guide is to isolate the fluid from the atmosphere and as a guide that provides a uniform even flow of fluid across the wafer or substrate at a controlled rate to insure uniform and controlled reaction rates. The relative spinning of either or both of the fluid guide and the wafer or substrate insures uniform fluid flow across the wafer or substrate and throws the used fluid off and away once it reaches the edge. In fact, the centrifugal force along with the fluid surface tension can be used to draw fresh fluid into the gap or reaction zone. As described in connection with FIGS. 3–10, depending on the fluid flow pattern desired, the fluid guide may be flat or contain outwardly extending grooves, ridges or protrusions. The surface can be chosen to optimize fluid flow across the wafer or substrate and to enhance mixing to insure optimal reaction conditions across the wafer or substrate. The use of grooves is shown in FIGS. 9A and 9B in which guide 12 may be given spiral grooves 70 which form an "X" over the central orifice 72. Alternatively, the grooves may be replaced as illustrated in FIGS. 10A and 10B by spiral ridges 74 with different combinations of the above patterning of the fluid guide being within the scope of this invention.

Figure 11:
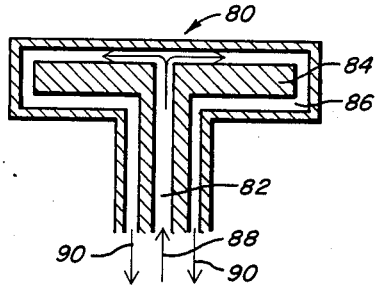
FIG. 11 is a cross-sectional and diagrammatic view of a vacuum chuck utilized in connection with the chemical reactor in FIGS. 1 and 2 in which the chuck acts as a heat source or sink which is heated or cooled by a fluid flow within the vacuum chuck.

Referring now to FIGS. 11 and 12, it is the purpose of the apparatus shown therein to control the wafer or substrate temperature or to help control reactions or drying processes.

Referring to FIG. 11, chuck 80 may include an interior channel 82 into which cooling or heating fluid is pumped up and over an interior plate 84 and down through an exit channel 86 such that fluid enters as illustrated by arrow 88 and exits as illustrated by arrows 90. The chuck or holder is such that the wafer or substrate is held to the chuck by vacuum or adhesive material. The chuck is generally to be made of conducting material such as metal, although it may be coated with a nonreactive film such as Teflon to protect it from reactive chemicals. The use of fluid cooling, such as illustrated in FIG. 11, causes the chuck to act as a heat sink. Alternatively, heat may be applied to the chuck by virtue of the temperature of the fluid pumped through the chuck of FIG. 11.

Figure 12A:
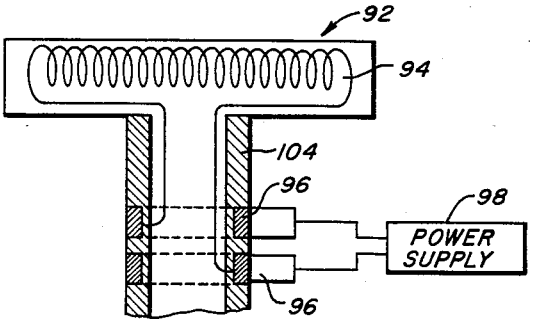
FIG. 12A is a diagrammatic and cross-sectional view of the vacuum chuck for use in the chemical reactor of FIGS. 1 and 2 in which the chuck is heated throughout, with the heating element connected via slip rings to a power supply.
Figure 12B:
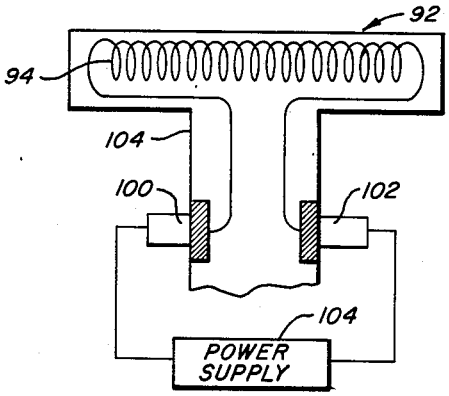
FIG. 12B is a diagrammatic and cross-sectional view of a heated vacuum chuck illustrating a power supply provided to a nonrotating vacuum chuck.

Referring to FIGS. 12A and 12B, chuck 92 may be provided with an electrical heating coil 94 therein which is powered in the FIG. 12B embodiment via slip rings 96 and a power supply 98; whereas, in the FIG. 12B embodiment for a stationary chuck, power is supplied via contacts 100 and 102 from a power supply 104. In both cases the shaft 104 which supports the top surface of the chuck is electrically nonconductive.

Note, Pelletier devices may be used within the chuck for cooling the substrate.

Optical Monitoring

As indicated earlier, one of the relatively important features of the utilization of a predetermined gap and the utilization of a fluid guide is the maintenance of a constant thickness optical path to be able to monitor the chemical reaction occurring at the surface of the wafer. With transparent wafers, as illustrated in FIG. 1, a source and detector may be located on opposite sides of the apparatus. However, referring to FIG. 13A, an opaque guide 12 is provided with a window 110 so that a light beam from a light source 120 going through a half-silvered mirror 114 passes through window 110 and impinges on surface 32 of wafer 14, with wafer 14 being held on chuck 16 as illustrated. Light is reflected from the top surface of the wafer back through the semi-reflective mirror 114 to a detector 116. The detector monitors the extent of reaction on the wafer to permit precise control of the reaction times and the reaction compositions. This is accomplished by the detector monitoring the changes in the reflected light caused by change at the substrate surface or concentration of reactants or products in the fluid. These observed changes are used to regulate the flow of chemicals or to change to a different chemical or a rinse, with the detector output being coupled to suitable circuitry within fluid flow controller 26.

For instance, for precise control of the development of the photoresist to give critical dimension control, it may be desirable to develop the resist until a specified area is free of resist, or has been free of resist for a specific period of time, or the thickness of a certain area has changed by a specified amount or a specified pattern is formed in the resist. Similarly, for etching films such a silicon dioxide, it may be desirable to etch until a certain area has changed in thickness by a specific amount, a specific area is free of film, or has been free for a specified period of time. This thickness may be measured via interferometric techniques.

The wavelength of the radiation is chosen so that the film (resist, oxide layer, etc.) is at least partially transparent to the radiation. Thus some of the light will reflect off of the upper surface of the film while the remainder will pass through the film and will be reflected by the substrate. Thus the two reflected beams will combine constructively or destructively depending on the thickness and refracture index of the film. Absorption by the film will attenuate the signal intensity and can also be used to determine the thickness.

Figure 13A:
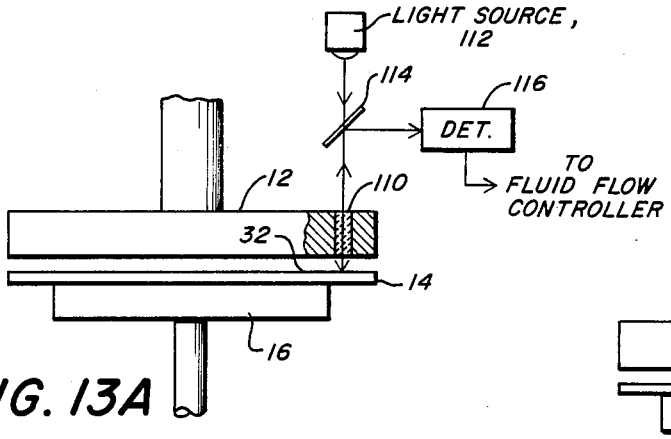
FIGS. 13A, 13B and 13C are schematic diagrams of a system for detecting the chemical reaction taking place at a predetermined location on a wafer, including the utilization of a fluid guide having a window, a light source and a detector, in which the chemical reaction in the gap between the guide and the wafer is monitored along a constant optical path length.

In order to utilize interferometric techniques, monochronomatic light sources are generally utilized. In one embodiment, the light from a laser is directed onto the wafer or substrate such that the angle of incidence is perpendicular to the wafer or substrate and the angle of reflection is also perpendicular to the substrate or nearly perpendicular. Then the detector can monitor the degree of constructive or destructive interference caused by the reflection of the light from the resist or other film on the substrate. Another interferometric technique that can be employed uses radiation of a number of wavelengths. The detector then monitors the changes in constructive or destructive interference seen in the different wavelengths to follow change in the film. In one embodiment, the fluid flow guide is rotated while the substrate remains fixed. If the assembly shown in FIG. 13A is employed in this fashion, the entire fluid guide must transmit the light or else the window would have to extend all the way around the fluid flow guide. If nonuniformity in the fluid flow guide causes excessive noise in the detected signal, the signal maybe measured at only certain times when the light is passing through specified portions of the fluid guide. One mechanism to trigger the detector to make a measurement is by attaching a mirror to the rotating shaft of the fluid flow guide so that it reflects a signal to a detector to trigger the desired measurement.

Figure 13B:
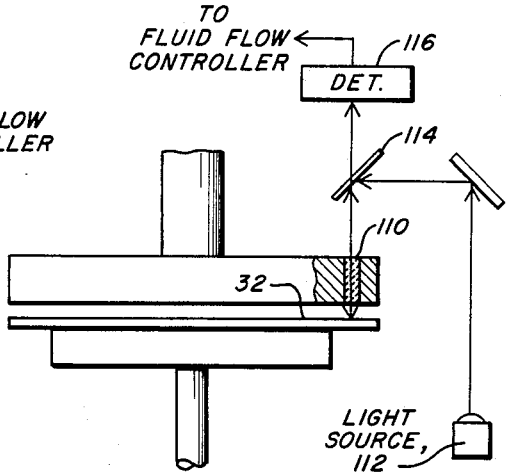
Figure 13C:
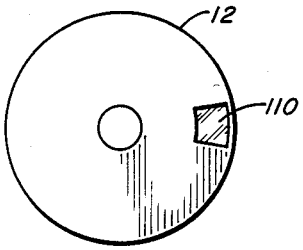

In the embodiment in which the substrate is rotated and the fluid flow guide is fixed, the surface of the substrate may vary as it passes under the light. Thus it may be advantageous to monitor the process at only selected portions of the substrate. This can be accomplished by attaching a slotted wheel to the wafer chuck shaft in FIG. 13B so that the light will be blocked by the wheel except when one of the slots permits transmission, with the slots being aligned with the regions to be monitored on the substrate.

Wafer Irradiation

Figure 14A:
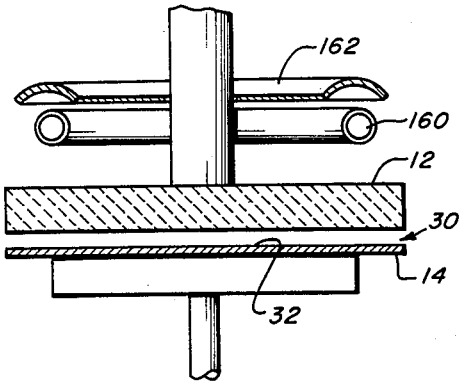
FIGS. 14A and 14B are, respectively, side, cross-sectional and top cutaway views of a ring light source utilized for illuminating the wafer surface through a transparent fluid guide for providing radiation to cause photochemical reactions on a wafer.
Figure 14B:
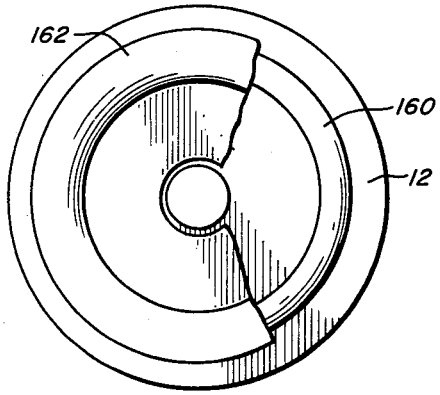

Referring to FIG. 14A, it is sometimes desirable to utilize radiation to enhance the chemical reaction in gap 30 between a transparent fluid guide 12 and wafer 14. For this purpose, a circular light source 160 may be utilized with a reflector 162 which provides radiation down through the light guide and onto top surface 32 of wafer 14. A top cutaway view of this reflector is illustrated in FIG. 14B. The circular or ring shape for the light source may be a fluorescent or discharge tube with a radiation collector or reflector being employed to increase the intensity of the radiation and to increase the uniformity of the radiation across the wafer or substrate. In one embodiment, the diameter of the feed tube may be minimized to minimize the interference with the light source. The fluid guide may be made in a frosted or fish eye pattern on one side to disburse the radiation to increase to homogeneity of the radiation reaching the top of the substrate. Other noncircular light source configurations can also be employed.

Bubble Elimination

Occasionally bubbles exist depending on the flow rate of the fluid; and, in one embodiment, the procedure for eliminating bubbles is to begin fluid flow before beginning any spinning with the spinning beginning when the gap is thoroughly filled. This helps insure the filling of the gap and lessens the probability of void formation. To help reduce bubble retention in the fluid, a slow spin speed is generally desirable. In one embodiment, to insure proper filling of the fluid gap, the fluid guide may be maintained at a relatively large gap when the fluid begins to flow and then narrowed to the preferred distance.

Figure 15A:
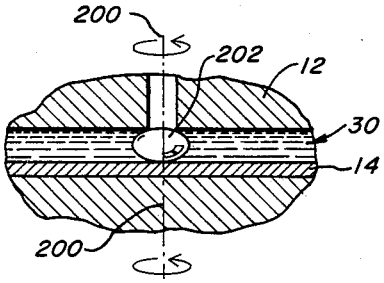
FIG. 15A illustrates the formation of a bubble at the central fluid introduction channel orifice in which both the fluid guide and the wafer are rotated about the same axis.

Referring to FIGS. 15A and B, the offsetting of the rotational axes of the guide and the wafer decreases bubble formation and improves fluid flow, with the shift of the axes of rotation being equivalent generally to that of the bubble size.

Figure 15B:
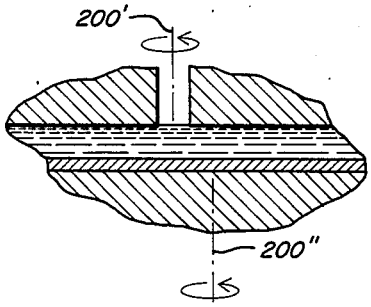
FIG. 15B is a cross-sectional and diagrammatic illustration of the elimination of the bubble formation of FIG. 15A through the utilization of offset axes of rotation for the fluid flow guide and the wafer.

Thus in FIGS. 15A and 15B, the chemical reaction pattern across a wafer or substrate may be modified by locating the axes or centers of rotation of the fluid guide and a wafer in an offset manner so that they are parallel but do not coincide. The coincident axis case is illustrated in FIG. 15A by axis 200 of fluid guide 12 and wafer 14, whereas in FIG. 15B, axis 200' is offset from axis 200''. This provides for more uniform mixing and also provides for the elimination of a bubble 202 from forming in the gap 30 portion illustrated in FIG. 15A.

Figure 16A:
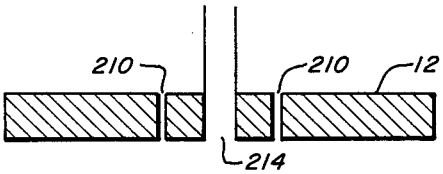
FIG. 16A is a cross-sectional and diagrammatic illustration of a fluid flow guide for use in the chemical reactor of FIGS. 1 or 2 illustrating the gas relief orifices adjacent the central fluid introduction channel.
Figure 16B:
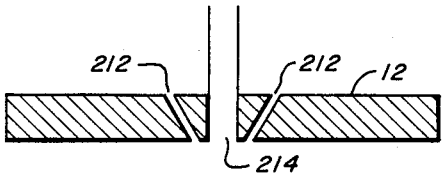
FIG. 16B is a diagrammatic and cross-sectional illustration of a fluid flow guide for use in the chemical reactor of FIGS. 1 or 2 illustrating angled gas relief channels in the guide.

Referring now to FIG. 16A and 16B, bubble elimination may be provided with gas elimination channels 210 or 212 in guide 12 adjacent the fluid introduction orifice here illustrated at 214 to permit air and fluid to flow back out of the system. These backflow openings present no problem in that the fluid backup therefrom can be easily collected.

Nonrotary Motion

Figure 17A:
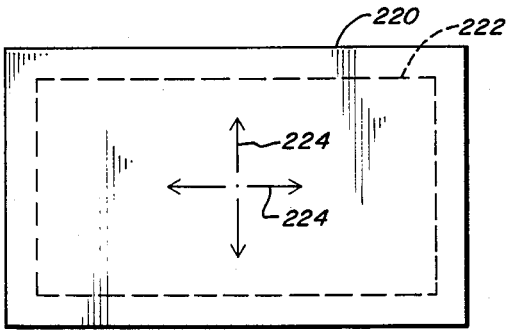
FIG. 17A is a diagrammatic illustration of a rectilinear motion system for use in the chemical reactor of FIGS. 1 or 2 illustrating an orthogonal vibratory motion useful in providing chemical mixing in the gap between the wafer and fluid flow guide.
Figure 17B:
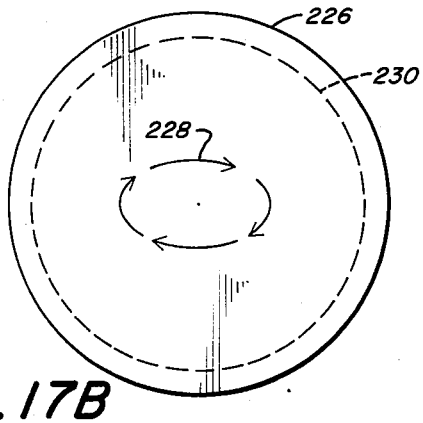
FIG. 17B is a top view of a orbital motion system for use in the chemical reactor of FIGS. 1 or 2 illustrating orbital motion for use in distributing the chemicals in the gap between the wafer and the fluid flow guide.

Referring now to FIGS. 17A and 17B, rectangular guides and substrates may be utilized in oscillating motion relative to each other. In FIG. 17A a guide 220 is oscillated with respect to a rectangular substrate 222, as illustrated by orthogonal arrows 224. Alternatively, in FIG. 17B fluid guide 226 is given a oscillatory orbital action as illustrated by arrows 228, via-a-vis a substrate 230. In these cases it may be advantageous to dispense the working fluids through a number of ports in the fluid guide to insure adequate distribution of fresh reactants to the entire surface of the water or substrate. Alternatively, instead of simple oscillatory or orbiting motion of the fluid guide and the wafer discussed above, this motion can be coupled with rotary motion to give yet another type of agitation and fluid flow control. For instance, in one embodiment the wafer or substrate rotates while the fluid guide oscillates or undergoes an orbiting motion or vice versa. Of course, the above-described motions can be made to occur with one component held stationary.

EXAMPLE I

To clean a group of 3-inch silicon wafers prior to oxidation, the apparatus was assembled as shown in FIG. 1. The fluid flow guide was similar to FIG. 9B except that the grooves were straight. Constructed from quartz, the fluid flow guide was a disc 3.5 inches in diameter and 0.25 inches thick with an orifice through the center and a six-inch long, 10 mm OD quartz tube fused to the disc over the orifice. The chemicals were fed to the orifice from the reservoirs and controller through appropriate tubing. The axes of the fluid flow guide and the wafer chuck were displaced 0.25 inches from each other. The fluid gap was adjusted to approximately 1.5 mm during operation, but lifts about 70 mm above the wafer for easy wafer loading and unloading. The chemical solutions employed to clean the wafers were the following:

(a) $H_2O$, $NH_4OH$, and $H_2O_2$ mixed in a ratio of 5:1:1 and warmed to 75° C.

(b) HF diluted with 9 parts $H_2O$ to 1 part concentrated HF and used at room temperature.

(c) $H_2O$, HCl, and $H_2O_2$ mixed in a ratio of 5:1:1 and warmed to 75° C.

The flow rate of all the liquids to the fluid flow guide were adjusted to a rate of 40 ml per minute. After the first wafer was centered on the vacuum chuck, DI water was started through the fluid flow guide and the fluid flow guide was lowered into position over the wafer. The wafer spin speed was set at approximately 75 rpm. The solutions were fed through the fluid flow guide in a continuous uninterrupted fashion in the following order:

(1) Solution a for 3 minutes.
(2) DI water wash for 3 minutes.
(3) Solution b for 1 minute.
(4) DI water wash for 3 minutes.
(5) Solution c for 3 minutes.
(6) DI water wash for 4 minutes.

When the DI water was stopped, the wafer was accelerated to 4000 rpm and the fluid guide raised. Each wafer was spun for 30 seconds to dry it and then it was replaced by another wafer to be cleaned.

EXAMPLE II

In order to use the chemical reactor system to develop photoresists, four three-inch silicon wafers containing a silicon dioxide layer 600A thick were prepared by coating with photoresist. Three ml of 1-PR25 resist (a J. T. Baker Chemical Company positive photoresist) was dispensed onto each wafer and each was spun at 5000 rpm to give a 1.4 μm thick film. After baking the coated wafers in a convection oven at 95° C. for 30 minutes, the wafers were exposed on a contact aligner through a standard resolution mask with lines and spaces ranging from 2 μm to 10 μm. The four wafers were exposed to the following amounts of radiation:

(a) 91 $mJ/cm^2$
(b and c) 103 $mJ/cm^2$
(d) 114 $mJ/cm^2$

The resist-coated wafers were developed in the chemical reactor system described in Example I using the recommended developer PRD (a J. T. Baker Chemical Company product) diluted with three volumes of water to one volume of concentrated developer. The liquid flow through the fluid flow guide was adjusted to 40 ml per minute. After the wafer was placed on the vacuum chuck, the DI water was started through the fluid flow guide and the fluid flow guide was lowered into position over the wafer. The developer solution was fed through the fluid flow guide for 30 seconds followed by a DI water wash for 60 seconds. When the DI water was turned off, the spin speed was increased to 3500 rpm for 30 seconds to dry the wafer. The process was repeated for the other three wafers.

EXAMPLE III

To use the chemical reactor system to etch a pattern into a silicon dioxide layer on a silicon wafer, wafers c and d of Example II with patterns developed in the photoresist were prepared by first baking at 125° C. in a convection oven for 30 minutes. A standard 10:1 buffered oxide etch solution was used for etching. The chemical reactor assembly described in Example I was employed with the liquid flow rate adjusted to 30 ml per minute, and the wafer spin speed set at approximately 75 rpm. After wafer c was centered on the vacuum chuck, DI water was started through the fluid flow guide and the fluid flow guide was lowered into position over the wafer. Then the etch solution was fed through the fluid flow guide for 100 seconds. This was followed with no interruption by a DI water wash for 120 seconds.

EXAMPLE IV

Resist stripping in the chemical reactor was performed in conjunction with the etching process described in Example III. After completion of the etch and water rinse steps, a positive photoresist stripper, PRS-1000 (a J. T. Baker Chemical Company product) at 75° C. was fed to the fluid flow guide for 3 minutes. This was followed without interruption by a 2.5-minute DI water wash. Upon completion of the water wash, the water flow was stopped, the spin speed increased to 2500 rpm and the fluid flow guide raised. After the wafer was spun for 25 seconds to dry it, the wafer was replaced by the next one to repeat the process.

It will be appreciated that many of the above operations can be done sequentially without removal of the wafer. Thus in one sense the subject reactor provides for continuous processing in which the substrates are prevented from becoming contaminated through a number of processing operations.

Having above indicated a preferred embodiment of the present invention, it will occur to those skilled in the art that modification and alternative can be practiced within the spirit of the invention. It is accordingly intended to define the scope of the invention only as indicated in the following claims.

What is claimed is:

1. A chemical reactor for use in processing substrates in which substrate contamination is minimized comprising:

a holder adapted to secure a substantially planar substrate in a predetermined orientation;

a fluid flow guide located adjacent to and spaced from said substrate, said guide having a substantially planar surface parallel to the planar surface of said substrate;

means including flow control means for delivering fluid through said guide during processing such that fluid occupies all of said gap during processing;

means for adjusting the gap between said guide and said substrate; and means for providing relative movement between said guide and said substrate.

2. The reactor of claim 1 wherein said movement is rotary movement.

3. The reactor of claim 2 wherein said substrate is rotated relative to said guide, said guide being maintained stationary.

4. The reactor of claim 2 wherein said guide is rotated relative to said substrate, said substrate being maintained stationary.

5. The reactor of claim 2 wherein said substrate and guide are rotated in opposite directions.

6. The reactor of claim 1 wherein either said guide or said substrate is maintained stationary.

7. The reactor of claim 1 wherein said holder includes means for controlling the temperature of said substrate.

8. The reactor of claim 7 wherein said temperature control means includes means for circulating a fluid of controlled temperature within said holder.

9. The reactor of claim 7 wherein said temperature control means includes electrical means for controlling the temperature of said holder.

10. The reactor of claim 9 wherein said electrical means includes a heating coil within said holder and means for applying electrical energy to said coil.

11. The reactor of claim 9 wherein said electrical means includes a Pelletier device.

12. The reactor of claim 1 wherein said guide includes means at said planar surface for increasing the mixing distribution of fluid dispensed therethrough.

13. The reactor of claim 12 wherein said means for increasing mixing includes outwardly running grooves in said guide surface.

14. The reactor of claim 12 wherein said means for increasing mixing includes outwardly running ridges on said guide surface.

15. The reactor of claim 1 wherein said fluid delivery means includes one or more apertures through and adjacent to the center of said guide.

16. The reactor of claim 15 wherein at least one of said apertures includes an expanded divided orifice.

17. The reactor of claim 15 wherein at least one of said apertures is restricted at said guide surface.

18. The reactor of claim 15 wherein at least one of said apertures is flared outwardly towards said substrate.

19. The reactor of claim 15 wherein one of said apertures is at the center of said guide and further including fluid release channels through said guide adjacent the center thereof to prevent fluid bubbles from existing in the gap between said guide and said substrate.

20. The reactor of claim 5 wherein the axes of rotation of said guide and said substrate are offset to prevent bubble formation.

21. The reactor of claim 1 and further including means for monitoring a predetermined parameter of the fluid in said gap.

22. The reactor of claim 21 and further including means for modifying the fluid flow through said guide responsive to said monitored parameter.

23. The reactor of claim 21 wherein said monitoring means includes means for directing light into said gap and for detecting light in said gap.

24. The reactor of claim 23 wherein said light directing means includes means for establishing a light path through at least a portion of said guide.

25. The reactor of claim 24 wherein said light path establishing means includes an optically transparent window in said guide.

26. The reactor of claim 1 wherein said guide is optically transparent to light of a predetermined wavelength.

27. The reactor of claim 26 and further including a light source and means for directing light through said guide and into said gap.

28. The reactor of claim 27 wherein said light source is circular and is centered above said guide.

29. A method for improving the reduction of contamination in the treatment of substrates processed with chemicals which contact a top surface in the substrate comprising the steps of:

providing the substrate and a holder therefor;

providing a fluid flow guide immediately above the substrate;

providing relative motion between the substrate and the fluid flow guide such that any chemical reaction taking place on said substrate does so through a combined mixing action and centrifugal force action which causes the chemicals to flow from the center of the substrate outwardly; and providing that the gap between the fluid flow guide and the substrate is such that the gap is continuously filled with fluid during processing in which any active chemical reaction is taking place on the surface of the substrate.

30. The process of claim 29 and further including the step of initially providing a relatively large gap and after introduction of fluid into the gap reducing the gap thereby to reduce the formation of bubbles within the gap.

31. The method of claim 29 wherein the process includes a drying step in which the relative motion of the substrate with respect to the fluid guide is rotary and at low rpm, wherein the working fluid which creates the chemical reaction is replaced by an inert gas, and wherein the relative speed of rotation between the guide and the substrate is increased by at least an order of magnitude during the drying process.

* * * * *